US007361823B2

(12) United States Patent
Rush

(10) Patent No.: US 7,361,823 B2
(45) Date of Patent: Apr. 22, 2008

(54) DRUM WITH REPLACEABLE BEARING EDGE

(76) Inventor: Mark A. Rush, 7610 Courtland Dr., Rockford, MI (US) 49341

( * ) Notice: Subject to any disclaimer, the term of this patent is extended or adjusted under 35 U.S.C. 154(b) by 12 days.

(21) Appl. No.: 11/122,923

(22) Filed: May 5, 2005

(65) Prior Publication Data

US 2006/0249005 A1 Nov. 9, 2006

(51) Int. Cl.
*G10D 13/02* (2006.01)

(52) U.S. Cl. ..... 84/411 R; 84/421

(58) Field of Classification Search ..... 84/411 R, 84/421, 411 M

See application file for complete search history.

(56) References Cited

U.S. PATENT DOCUMENTS

| | | | | |
|---|---|---|---|---|
| 5,353,674 | A | 10/1994 | Volpp | |
| 5,675,099 | A | 10/1997 | Granatello | |
| 6,483,017 | B1 * | 11/2002 | Dill et al. | 84/411 R |
| 6,515,208 | B2 * | 2/2003 | Cleland | 84/411 R |
| 6,580,023 | B2 * | 6/2003 | Belli | 84/411 R |
| 7,138,574 | B1 * | 11/2006 | Spinazzola | 84/411 R |
| 7,214,867 | B1 * | 5/2007 | Gatzen et al. | 84/411 R |
| 2003/0029301 | A1 * | 2/2003 | Belli | 84/411 R |
| 2006/0156898 | A1 * | 7/2006 | Nickel | 84/411 R |

* cited by examiner

*Primary Examiner*—Gary F. Paumen
(74) *Attorney, Agent, or Firm*—John A. Waters

(57) ABSTRACT

A drum of the invention has a tubular drum shell, a replaceable annular bearing edge, a spline interconnecting the shell and the bearing edge, and a membrane overlaying the bearing edge. The bearing edge may have any of various profile configurations. The bearing edge overlays a shell edge in releasable engagement. A spline extends from the bearing edge and engages a recess, including an annular rabbet between the wall edge and an inside wall surface, or an annular void, including an annular slot dado, in the shell wall, releasably coupling the bearing edge and the shell. The shell may include an aperture through the wall. An air valve may be provided to regulate passage of air through the aperture between open and closed positions. The air valve may support an audio reception device. A portion of the inside wall surface may have an acoustic pattern that influences the drum's sound. The drum may also have a flangeless hoop or arcuate portions of the hoop without a flange. A point suspension tension lug may secure the head to the shell.

22 Claims, 8 Drawing Sheets

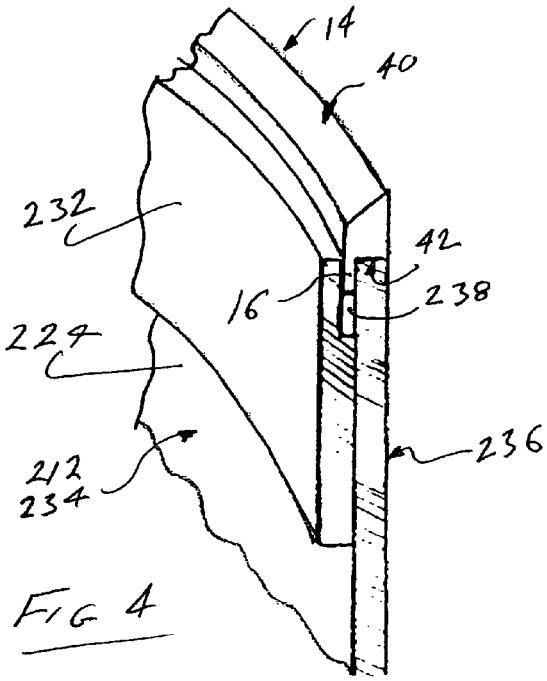
FIG 4
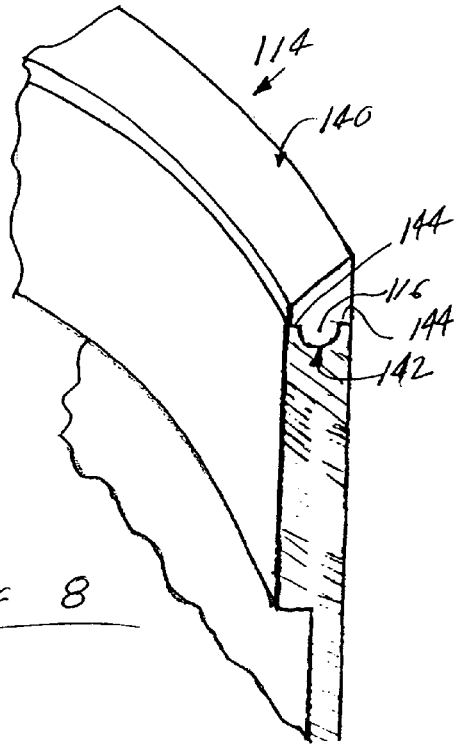
FIG 8
FIG 5
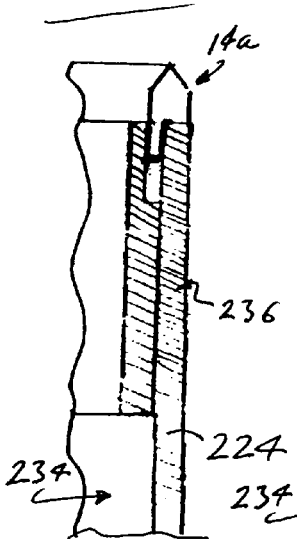
FIG 6
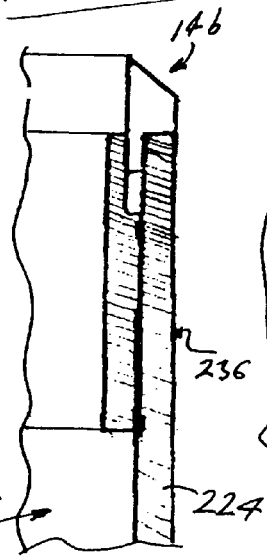
FIG 7
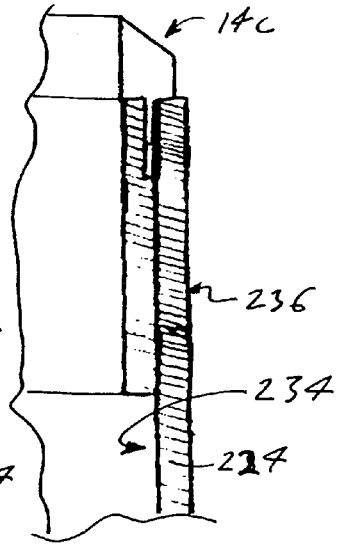

DRUM WITH REPLACEABLE BEARING EDGE

CROSS-REFERENCE TO RELATED APPLICATIONS

Not Applicable

BACKGROUND OF THE INVENTION

The present invention generally relates to musical instruments and more specifically to drums. Drums are not the simple instruments that they may appear to be upon first consideration. Rather, a drum's musicality is a culmination of various elements. A foundational or principal factor that influences the sound of a drum is the shape of the drum shell, both in size or dimensions and in contour or configuration. Thickness of a drum shell wall may vary from drum to drum and may itself be based on various elements including, for example, structural considerations of the drum size and tonal considerations of the drum sound. The contour of a drum also impacts the tonal quality of the drum. Consider the differences between the tapered shell of a conga drum and the cylindrical sidewalls of what is commonly referred to as a "tom" or "tom-tom."

On a more detailed or less conspicuous scale, that part of a drum which is struck in drumming, namely, a drum head skin or membrane that is stretched across a drum shell, its tension, its thickness, and its composition affect the tone and musicality of the drum. Further yet, that point at which the membrane contacts or interfaces with the drum shell, namely, the bearing edge, also affects a drum's tone. The drum shell wall edge may be formed with various contours and provide various drum tonal qualities, respectively. Three of various commonly known wall edge contours include a fully rounded symmetrical bearing edge, a rounded 45° bearing edge, and a chamfered bearing edge. The fully rounded bearing edge tends to boost middle to low range frequencies by providing maximum shell contact with the membrane. Middle to high range frequencies are boosted by a more focused bearing edge area for membrane to shell contact that is provided by a rounded 45 bearing edge, for example.

With the wall edge shaped and used as the bearing edge and with the wall edge in direct contact with the membrane, the bearing edge is an integral part of the drum shell and generally not subject to modification. Thus, beyond the apparent musical differences of different types of drums, conga, tom, bass, or snare, for example, a drummer requires multiple drums of each type or at least multiple drum shells to access for a given playing session the differing drum tonal qualities that result from various bearing edges.

Further, the interior shell wall surface may also influence a drum's tonal quality or sound. This is a well-recognized consideration, especially with regard to bass drums in which acoustic damping materials are commonly placed. In a simple form, the acoustic damping material may simply be a pillow placed within a bass drum. Alternatively, specifically designed fill materials may also be used. One factor that these damping techniques seek to address is the formation of standing sound pressure waves within the drum shell, which may or may not be desirable.

BRIEF SUMMARY OF THE INVENTION

Accordingly, a drum according to the invention provides improved flexibility to a drummer with regard to tuning or set-up of a drum for a given playing session as follows.

In one aspect of the invention, a drum has a tubular shell, at least one replaceable annular bearing edge, at least one flange or spline interposed between the shell and the bearing edge, and at least one membrane overlaying and preferably stretched across the bearing edge. The shell preferably has opposing first and second shell ends and an annular shell wall that extends between the opposing first and second shell ends. The shell wall further preferably has opposing first and second wall edges and opposing inside and outside wall surfaces. The annular bearing edge also preferably has an annular membrane surface and an opposing annular shell surface with the shell surface abutting the first wall edge in releasably engagement. The annular membrane surface may have any of various profile configurations, including without limitation, square round, oval, triangular, or multi-faceted. At least the first wall of the shell wall further can have at least one recess defined therein. A spline can extend from the first bearing edge shell surface into the recess in cooperating engagement and releasably coupling the bearing edge and the shell.

In another aspect of the invention, the recess defined in the first wall edge is an annular void that defines either one of an annular slot dado in the first wall edge and an annular rabbet between the first wall edge and the inside wall surface. In an alternative aspect, the recess defined in the first wall edge may be an annular void that defines an annular slot dado in the first wall edge, the spline may be a first spline, and the first annular bearing edge may further include a second spline that is spaced from the first spline and extends at least partially along the inside wall surface. Further, the first annular bearing edge may have at least one spline recess defined in the shell surface and the spline may further extend into the spline recess in cooperating engagement.

In a further aspect of the invention, the drum may include a second annular bearing edge similar to the first annular bearing edge, with an annular membrane surface and an opposing annular shell surface. The second bearing edge overlays the second wall edge with the bearing surface abutting the second wall edge. Further a second membrane preferably overlays and is preferably stretched across the second bearing edge.

Yet further, a drum according to the invention may be tuned or have its tonal quality adjusted with use of at least one aperture or air pressure release port through the shell wall. The port may further include an air valve that is adapted to regulate airflow through the aperture between open and closed positions. The air port may optionally include a body that extends through the aperture and defines an air passage through the drum shell and may further include a cover that engages the body and is adapted to support an audio reception device.

And still further, a drum according to the invention may have at least a portion of the drum shell inside wall surface include an acoustic pattern or texture whereby sound generated by the drum is influenced and undesirable standing wave patterns or the like, for example, are at least modified.

BRIEF DESCRIPTION OF THE SEVERAL VIEWS OF THE DRAWING

FIG. 4 is the view of FIG. 2 showing a second alternative installation of the replaceable bearing edge.

FIG. 5 is the view of FIG. 4 in end elevation and showing a first alternative configuration of the replaceable bearing edge thereof with a double chamfer membrane surface;

FIG. 6 is the view of FIG. 5 showing a second alternative configuration of the replaceable bearing edge thereof with an inside bearing edge membrane surface chamfer; and FIG. 7 is the view of FIG. 5 showing a third alternative configuration of the replaceable bearing edge thereof with an extreme inside bearing edge membrane surface chamfer.

FIG. 8 is the view of FIG. 2 showing a first alternative replaceable bearing edge according to the invention, which has a width that is not less than the shell wall edge thickness, and showing a first alternative spline;

DETAILED DESCRIPTION OF THE INVENTION

Figure 1:
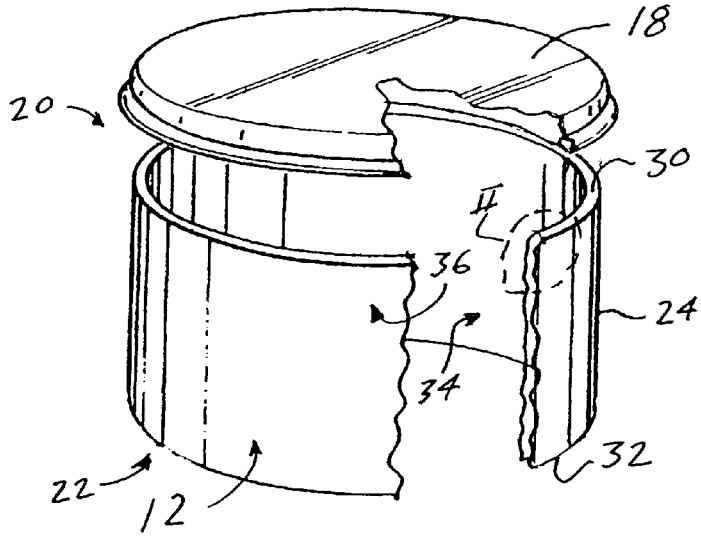
FIG. 1 is a partially fragmentary exploded perspective view of a drum shell and membrane.
Figure 2:
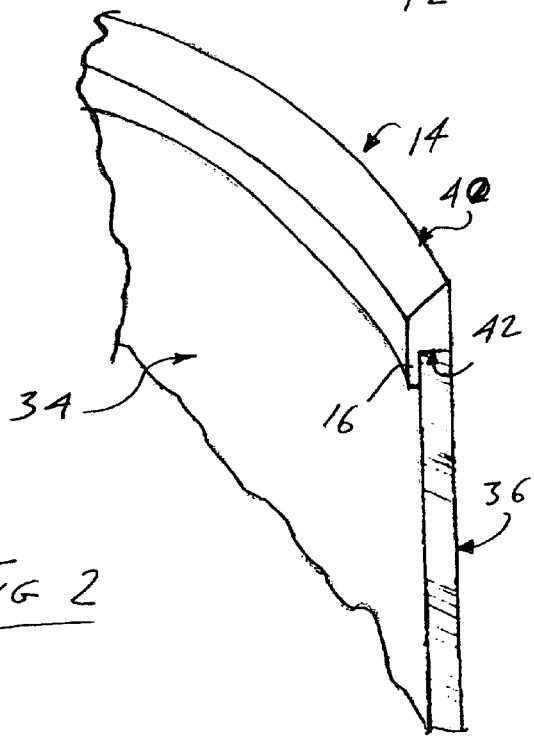
FIG. 2 is an enlarged, fragmentary perspective view taken at detail II of FIG. 1, showing a replaceable bearing edge according to the invention with an outside bearing edge membrane surface chamfer.

Referring to the drawing generally, and specifically with reference to FIGS. 1 and 2, a drum with a replaceable bearing edge according to the invention has a tubular shell or drum body 12, a replaceable bearing edge 14, a spline 16, and a membrane or drum head skin 18. Drum shells are commonly fabricated as tubular laminations of birch, maple, or mahogany veneers. A monolithic tubular molding of acrylic plastic may also be used to fabricate a drum shell. The tubular shell has opposing first and second shell ends, 20 and 22, respectively, and an annular shell wall 24. The shell wall extends between the opposing first and second shell ends from a first wall edge 30 to a second wall edge 32, respectively. The wall further has opposing inside and outside wall surfaces, 34 and 36, respectively. The membrane or skin 18 is overlaid and stretched over one of the shell ends, say the first end 20, and contacts one of the wall edges, say the first wall edge 30.

The point at which the membrane 18 contacts the annular shell wall 24 is the bearing surface and is commonly the annular shell wall edge 30. The wall edge may be contoured to provide various drum tonal qualities. Three of various common wall edge contours include a fully rounded bearing edge, a rounded 45° bearing edge, and a chamfered bearing edge. When a wall edge is shaped and used as the bearing edge, with the wall edge in direct contact with the membrane, the bearing edge is an integral part of the drum shell and generally not subject to modification. Use of a replaceable bearing edge 14 according to the invention, however, allows the bearing edge to be replaced.

Thus, a drummer may have different tonal qualities from a single drum shell 12 by merely replacing the bearing edge 14, rather than requiring multiple drum shells or multiple drums. A fully rounded bearing edge tends to boost middle to low range frequencies by providing maximum shell contact with the membrane. Middle to high range frequencies are boosted by a more focused area for head to shell contact that is provided by a rounded 45 bearing edge, for example. A chamfered bearing edge 14 as shown, focuses the head to shell contact area further, with associated boosting of high range drum frequencies. The annular membrane surface may further have any of various profile configurations, including without limitation, square, round, oval, triangular, or multi-faceted.

The bearing edge 14 is an annular member and may be constructed of any appropriate structural material, including plastics, metals, and suitable woods and composites thereof. The bearing edge 14 has a membrane surface 40 and an opposing shell surface 42. The spline 16 extends in a downward direction as shown in the drawing, from the shell surface 42 and keys the bearing edge 14 with the drum shell wall 24. As shown in FIG. 2, the spline overlays a portion of the inside wall surface 34, near the first wall edge 30. In this configuration, the bearing edge 14 may be sized for a tight slip fit engagement with the shell wall 24, preferably tight enough only so the replaceable bearing edge does not engage the shell 12 loosely.

Figure 3:
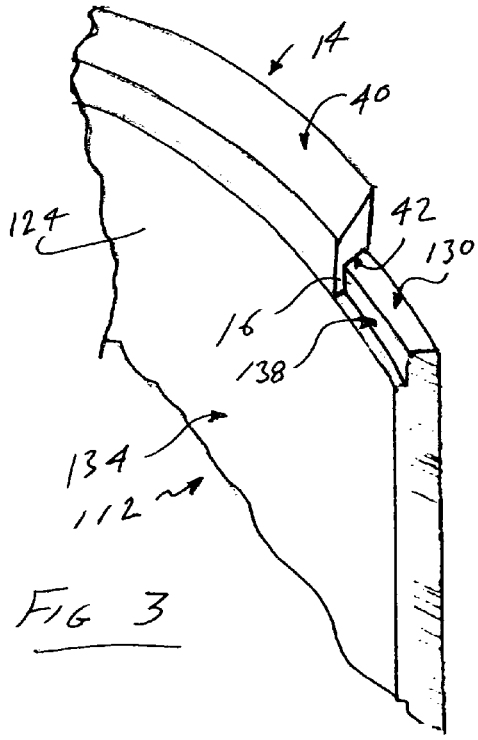
FIG. 3 is the view of FIG. 2 showing a first alternative installation of the replaceable bearing edge.

A first alternative preparation of a first wall edge 130 is shown in FIG. 3 with a rabbet between the first wall edge 130 and the inside wall surface 134. One having ordinary skill in the art, and one having ordinary skill in woodworking arts, for example, will appreciate that the rabbet interface between the bearing edge 14 and the shell wall 124 provides an increased degree of stability in the connection between the bearing edge 14 and the shell wall. Again, the sizing of the replaceable bearing edge 14 is preferably so the bearing edge does not engage the shell 112 loosely.

In a second alternative interface between the bearing edge 14 and the shell wall 224 (FIG. 4), an annular slot dado 238 is defined in the first wall edge. Again, one having ordinary skill in the art will know that the dado engagement of the bearing edge with the shell wall provides even further stabilization of the connection between the bearing edge 14 and the shell wall. The replaceable bearing edge 14, and more specifically the spline 16, may be sized for slip fit or force fit engagement of the spline 16 with the wall edge dado 238. One having ordinary skill in the art understands that not only are user preferences a factor in this fitting, material strength considerations are also to be considered.

As discussed above, drum shells are commonly fabricated as laminations of veneer materials. Depending upon the use and design preferences relative to a given shell, the laminations may number from about five to about twenty laminations. As one may expect, larger diameter drims may use a larger number of plies, although the greatest number of plies may be found in a snare drum, for example, rather than a bass drum. In some constructions, the shell may be constructed with a relatively lower number of laminations or plies relative to the drum size, to achieve a given tonal performance with additional reinforcement plies or hoops 232 (FIG. 4) laminated to the shell wall inside surface 234 near the shell ends. Thus, the shell wall may commonly be thickened and strengthened near an end or both ends with additional short plies or hoops. The reinforcement hoops may be required for various structural considerations as will be understood by one having ordinary skill in the art.

The additional reinforcement plies or hoops 232 may conveniently be configured during construction to define the wall edge 130 with dado 138 (FIG. 3) or to define the wall edge of shell 224 with a dado 238 (FIG. 4). While FIG. 4 shows the presence of the reinforcement hoops and FIG. 3 does not, this is not a limitation that the dado 238 is restricted to use of reinforcement hoops, while the rabbet 138 is not. To the contrary, the rabbet or the dado edge configuration may be employed with or without reinforcement hoops. The only limitation would be structural consideration relative to the shell wall thickness at the wall edge as is understood by one having ordinary skill in the art. To reiterate, either the rabbet 138 or the dado 238 may be used when reinforcement hoops 232 are used, and either rabbet 138 or dado 238 may be used when the shell wall is sufficiently thick without reinforcement hoops.

Figure 7A:
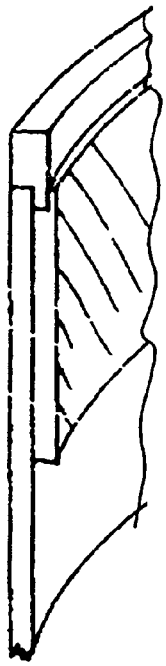
FIG. 7*a* is a mirror image of the view of FIG. 7 showing a square configuration of the replaceable bearing edge thereof.
Figure 7B:
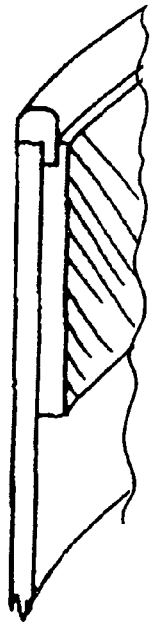
FIG. 7*b* is a mirror image of the view of FIG. 7 showing a round configuration of the replaceable bearing edge thereof.
Figure 7C:
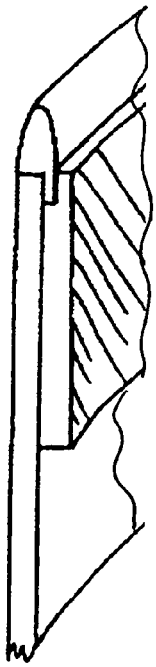
FIG. 7*c* is a mirror image of the view of FIG. 7 showing a oval or elliptical configuration of the replaceable bearing edge thereof.
Figure 7D:
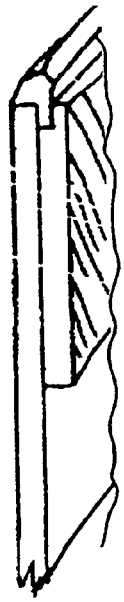
FIG. 7*d* is a mirror image of the view of FIG. 7 showing a multi-faceted configuration of the replaceable bearing edge thereof.
Figure 9:
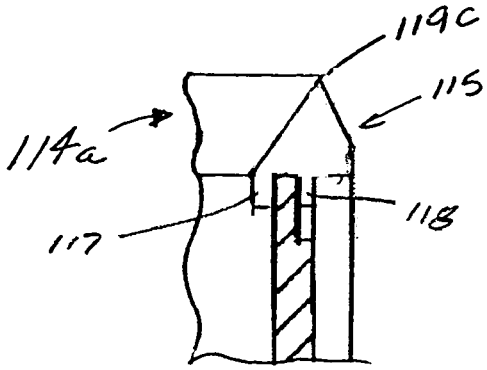
FIG. 9 is a fragment of the view of FIG. 8 in end elevation and showing a first alternative configuration of the removable bearing edge thereof with a recessed membrane surface.

Thus far, the replaceable bearing edge 14 of the invention has been shown as a chamfered or outside bearing edge (FIGS. 2-4). A replaceable bearing edge according to the invention may be configured with various membrane surfaces 40, however. A few of various examples are shown in the drawing as follows. As shown in FIG. 5, the bearing edge 14*a* has a double chamfered bearing edge in which the membrane surface is chamfered inside and out and has a central ridge. An inside bearing edge 14*b* is shown in FIG. 6. The inside bearing edge is substantially a reverse chamfer of the outside bearing edge 14. While the outside bearing edge 14, the double bearing edge 14*a*, and the inside bearing edge 14*b* are shown in the drawing as being flush with an outside wall surface 236 of the shell, the bearing edge may also be flush with an inside wall surface 234 of the shell, as shown by extreme inside bearing edge 14*c* in FIG. 7. Yet further examples of various replaceable bearing edge profile configurations, including without limitation, square (FIG. 7*a*), round (FIG. 7*b*), oval (FIG. 7*c*), or multi-faceted (FIG. 7*d*).

It is now noted that the replaceable bearing edge 14 discussed thus far is shown in the drawing as being thicker than the shell wall (FIG. 2), as being the same thickness as the shell wall (FIG. 3), and as being narrower than the shell wall (FIG. 4). Thus, the thickness of the replaceable bearing edge 14 relative to the shell wall is shown as being substantially immaterial to the inventive concept. Rather, these variations in configuration may result from personal preferences in manufacture or with regard to desired musical results.

Another alternative replaceable bearing edge configuration 114 is shown in FIG. 8. The bearing edge 114 has a rounded spline member 116 extending from the shell surface 142. The spline is shown centered on the shell surface with adjoining shoulder portions 144. The shoulder portions may be optional. Structural considerations in deference to qualities and characteristics of the materials used for the shell wall will indicate the desirability and configurations of the shoulders 144 as needed to avoid splitting of the shell wall, for example. It is also noted that various configurations of the shell surface 142, for example, on the replaceable bearing edge may be more or less desirable because of such structural considerations and further because of considerations with regard to torsional stability of the bearing edge. For example, if the shell surface is circular or cylindrical, the bearing edge may have a tendency to roll relative to the shell wall edge, which would be undesirable.

Figure 13:
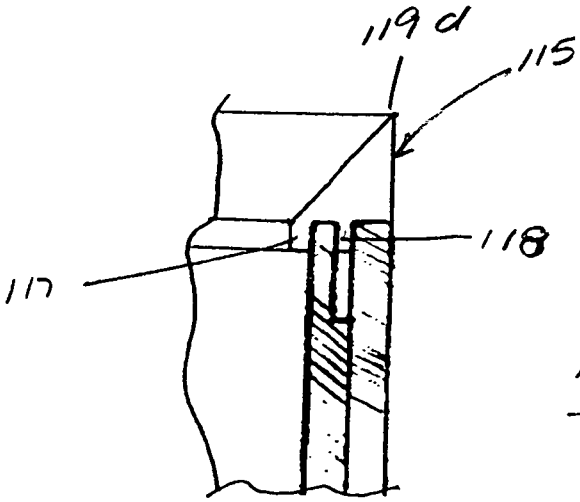
FIG. 13 is the view of FIG. 9 showing a fifth alternative configuration of the bearing edge that includes a second spline.
Figure 14:
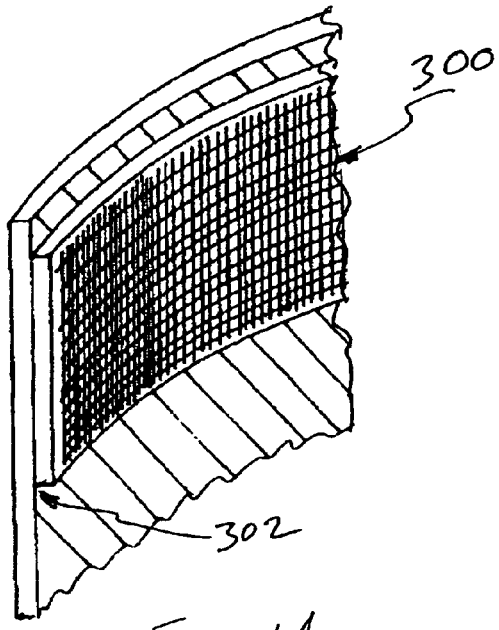
FIG. 14 is a fragmentary perspective view of an inside wall surface of a drum shell showing a first acoustic treatment of the inside surface of the shell wall.
Figure 15:
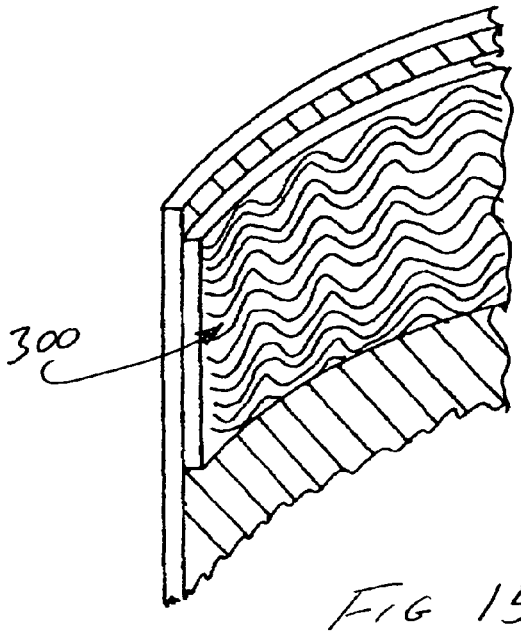
FIG. 15 is the view of FIG. 14 showing a first alternative acoustic treatment thereof.
Figure 16:
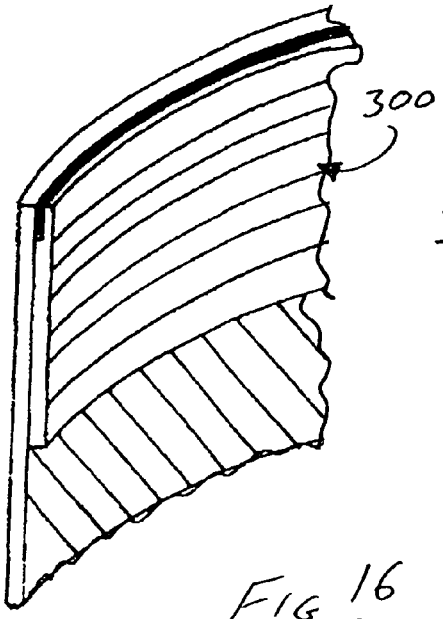
FIG. 16 is the view of FIG. 14 showing a second alternative acoustic treatment thereof.
Figure 17:
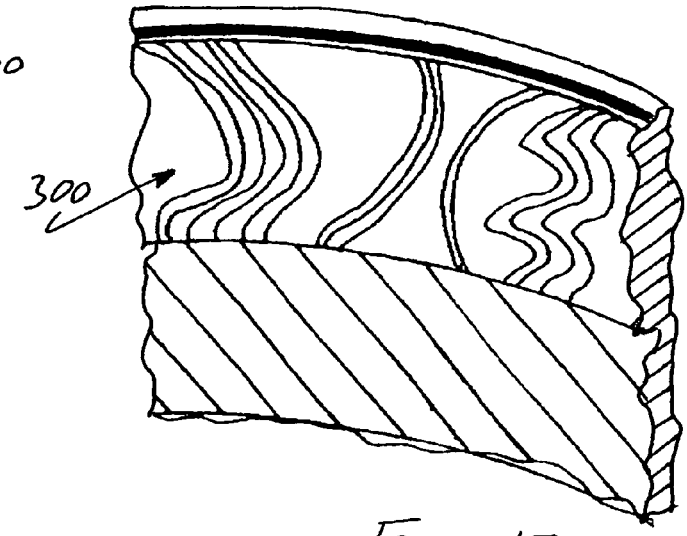
FIG. 17 is the view of FIG. 14 showing a third alternative acoustic treatment thereof.

Desirable alternative configurations of the replaceable bearing edge include bearing edges 115 with shell surfaces having double flanges 117 and 118, as shown in FIGS. 9, 11, 12, and 13. These include bearing edges with an extreme inside membrane surface edge (FIG. 12); an inside membrane surface edge 119*b* (FIG. 11); an outside membrane surface edge 119*c* (FIG. 9); and an extreme membrane surface edge 199*d* (FIG. 13). These double flanges provide stable mounting for the replaceable bearing edge. Configuration of the shell surface of the replaceable bearing edge is not limited to the configurations shown in the drawings. Other configurations are possible.

Figure 10:
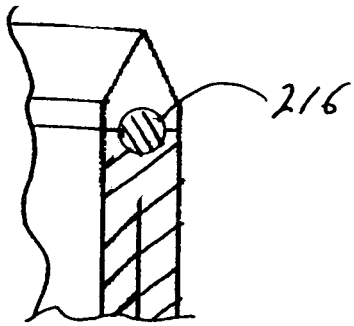
FIG. 10 is the view of FIG. 9 showing a second alternative configuration of the removable bearing edge thereof with a double chamfer membrane surface and showing a second alternative spline.
Figure 11:
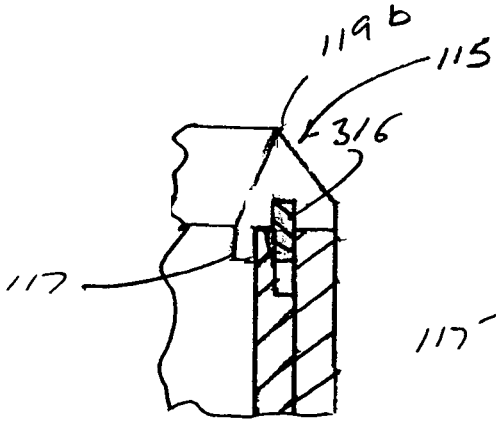
FIG. 11 is the view of FIG. 9 showing a third alternative configuration of the removable bearing edge thereof with a modified inside bearing edge membrane surface and showing a third alternative spline.
Figure 12:
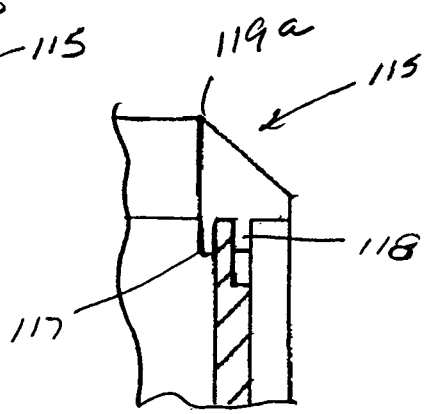
FIG. 12 is the view of FIG. 9 showing a fourth alternative configuration of the removable bearing edge thereof with an extreme inside bearing edge membrane surface chamfer.

As with the specific configuration of the shell surface of the replaceable bearing edge according to the invention, the flanges or spline also are not limited to the configurations shown in the drawings. For example, in addition to flanges formed on the bottom of the bearing edges, the flanges can be separate spline members. Two additional exemplary spline configurations include a separate cylindrical spline 216 (FIG. 10) and a separate rectangular spline 316 (FIG. 11). One having ordinary skill in the art understands that a variety of spline configurations, either attached or separate from either of the replaceable bearing edge or the shell wall may be more or less desirable under specific playing and manufacturing situations.

Further, some drums will have one drum head with one membrane stretched over one end of the shell as indicated (FIG. 1) and as is well known, while other drums will have two drum heads with a second membrane stretched over the other of the two opposing shell ends 20 and 22, which is also well known by one having ordinary skill in the art and thus not indicated in the drawing. Thus, showing in the drawing a removable bearing edge at one end of a drum is not a limitation of the invention or the claims. Rather, a removable bearing edge according to the invention may be employed at one or both drum shell ends according to a user's preferences. Further, when a removable bearing edge according to the invention is used at each of a drum's opposing ends, the bearing edges used may have the same or differing configurations.

In another aspect of the invention, a drum shell 12 (FIG. 1) has acoustic texturing or acoustic patterning generally shown at 300 in FIGS. 14-17. Regular texture patterns (FIGS. 14-16) or more arbitrary or random patterns (FIG. 17) may be employed to various effects. Standing sound pressure waves may develop within a drum shell, which may or may not be desirable. Either way, the tonal character of a drum shell may be affected or "tuned" by tuning the over all configuration of the shell, as one having ordinary skill in the art knows. Further, the tonal character of a drum may also be tuned by tuning the shell wall inside surface with contour or texture.

While reinforcing hoops are shown in the drawing with acoustic texturing 300 of the hoops, the placement of acoustic texture upon the inside surface of the shell wall is not limited in the inventive concept to placement of acoustic texture upon a reinforcement hoop as shown. Rather, the inventive concept of acoustic texturing or acoustic patterning of the shell wall inside surface should be broadly understood as being independent of a presence of a shell reinforcement hoop. The variations shown in the drawing are merely a few of numerous and various acoustic patterning anticipated in the invention.

Another example of an acoustic patterning element within the scope of the invention includes an interface 302 (FIG. 14) between a reinforcement hoop, which may be used in a drum shell, and the drum shell wall, for example. As shown, the reinforcement hoop simply has a squared wall edge, and the acoustic pattern defined by this interface is merely a stepped wall from the reinforcement hoop to the shell wall. Alternatively, this interface may include a chamfer or other contouring, for example. Thus, one having ordinary skill in the art will understand from this description and from the drawing, that acoustic patterning of the inside surface of a drum shell will affect the tonal quality of a drum and may be implemented with or with out the presence of reinforcement hoops.

Figure 18:
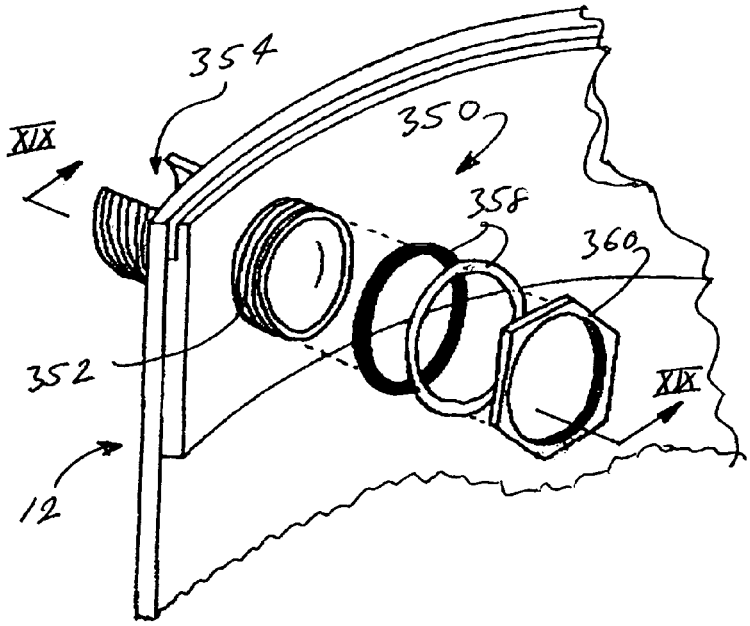
FIG. 18 is the view of FIG. 14 showing an air relief port in the shell wall in exploded view.
Figure 19:
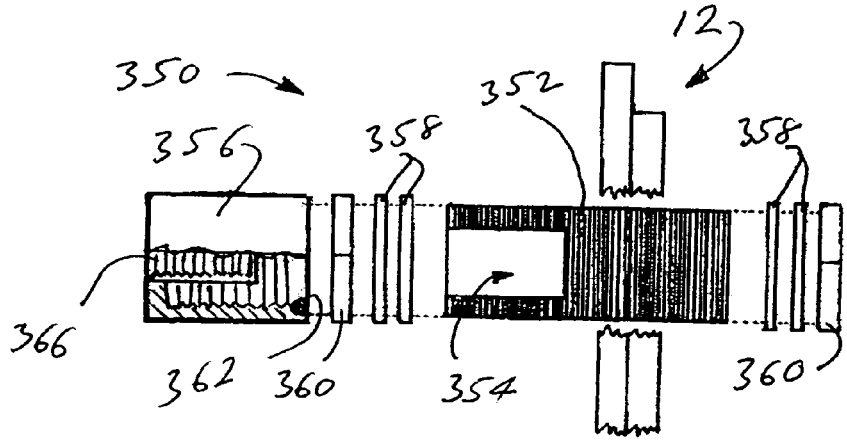
FIG. 19 is a partial fragmentary, partial elevational exploded view of the air port of FIG. 18, taken along line XIX-XIX of FIG. 18.
Figure 20:
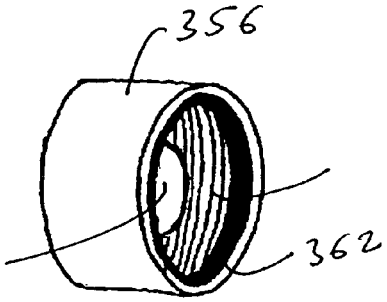
FIG. 20 is an interior perspective view of a cap of the air port.

In yet another aspect of the invention, a drum shell 12 has an adjustable pressure air release port 350 (FIGS. 18 & 19). The release port has a body portion 352 which may be provided as a threaded tubular rod or pipe-like member with an aperture or notch 354 in a side of the body. The notch is positioned outside the drum shell while the body extends through the shell to the interior of the drum shell. Thus, an air passage is defined through the tubular body. The release port is adjustable by virtue of a cap 356 that may be placed on an exterior end of the body. By providing screw threads on an exterior of the body and cooperating interior screw threads within the cap, the cap may conveniently be screwed on and off the port body, covering and revealing or closing and opening the notch respectively. While the cap covers or reveals the notch, the adjustable release port is tuned and so the drum is tuned.

The body of the adjustable pressure air release port may conveniently be mounted through the drum shell wall with interior and exterior washers 358 and nuts 360 (FIG. 19). The washers and nuts may be fabricated of any suitable structural material, including without limitation, metals, plastics, and suitable woods and composites thereof. Also, while a reinforcement hoop is again shown in the drawing, its presence is immaterial.

The cap 356 may further be provided with a plastic interior bushing 362 or the like, whereby the cap resists rotation or screw threading onto or off of the port body and the cap is held by the bushing in a predetermined position relative to the body. Further, the cap may be provided with a second interior thread 366, whereby a screw (not shown) may be coupled with the cap and a microphone or other audio reception device may be mounted on the adjustable pressure air release port 350, near the drum.

As discussed above, when a wall edge is shaped and used as the bearing edge or a membrane surface, with the wall edge in direct contact with the membrane, the bearing edge is an integral part of the drum shell and generally not subject to modification for reasons that are known to one having ordinary skill in the art. This modification may also include repair of the integral bearing edge. Use of a replaceable bearing edge 14 according to the invention, however, allows the bearing edge to be replaced with some of the benefits already discussed above. Further, a replaceable bearing edge 14 according to the invention also reduces potential damage to the bearing edge and the shell edge and even facilitates such repair by merely replacing the bearing edge.

Figure 21:
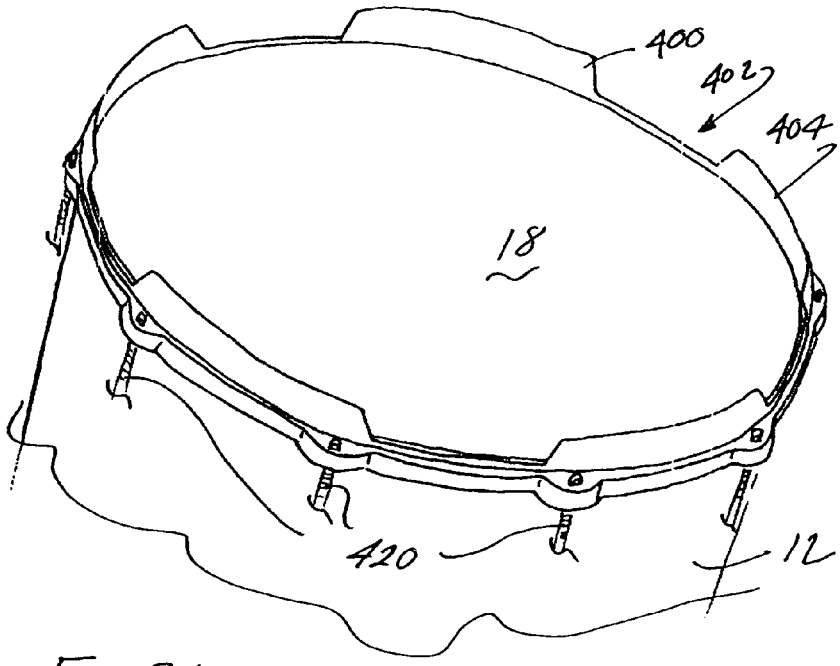
FIG. 21 is fragmentary perspective view of a drum head with a sectional or multi-flange drum hoop of the invention.
Figure 22:
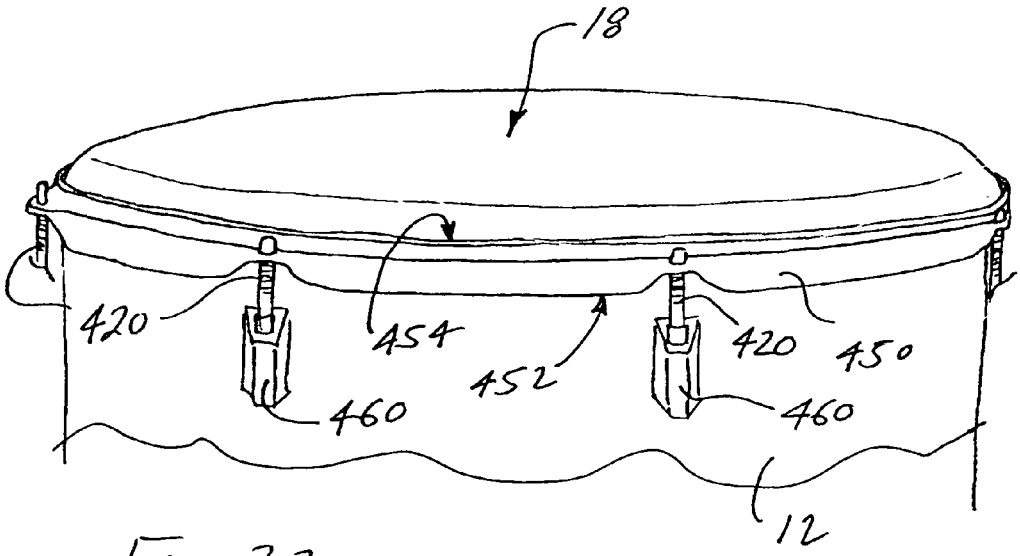
FIG. 22 is a fragmentary perspective view of a drum head with a non-flange or flangeless drum hoop of the invention.
Figure 23:
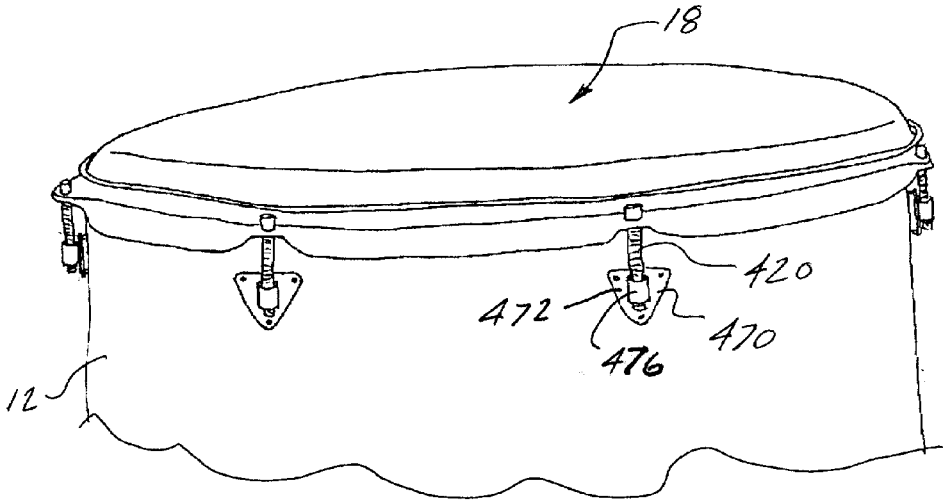
FIG. 23 is a fragmentary perspective view of a drum head showing a tensioning system of the invention with point suspension lug.
Figure 26:
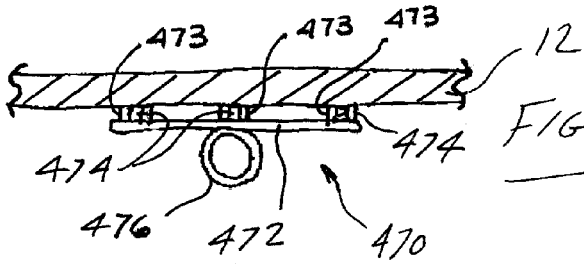
FIG. 26 is a top plan view thereof.
Figure 24:
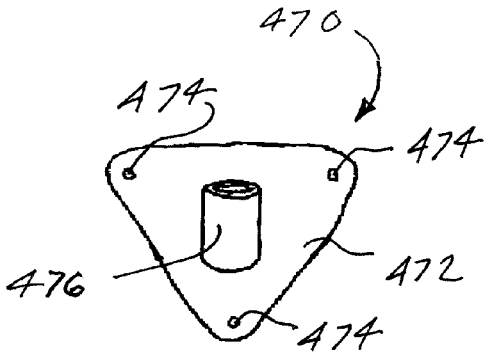
FIG. 24 is a front elevation view of a drum head tensioning system point suspension lug of the invention.
Figure 25:
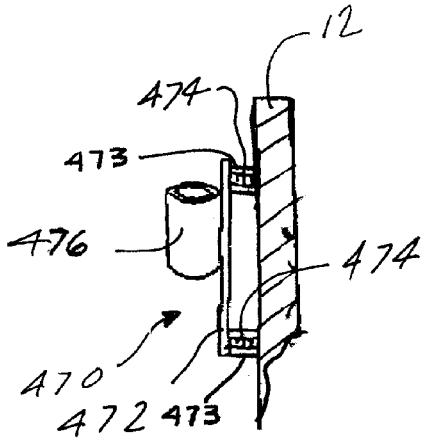
FIG. 25 is a side elevation view thereof.

Thus, another feature of the invention is shown in the drawing at FIGS. 21 & 22, namely, a non-flange or flangeless drumhead hoop. More specifically, modern drums have a hoop with a prominent flange, that is a flange that extends beyond or above the drumhead and membrane. This hoop or rim flange protects the bearing edge from potential damage to the bearing edge when a drummer hits the bearing edge, "takes a rim shot." While a rim shot may occur accidentally, it is also often a deliberate drum stroke. Similarly and to a lesser degree, the hoop rim also protects against damage to the bearing edge from a "stick slap," when a side of a drum stick is slapped against the membrane. With a replaceable bearing edge of the invention, the shell edge may be protected and a possibly damaged bearing edge is relatively easily repaired by replacement, rather than by a hoop flange. The hoop flange may, therefore, be reduced or removed.

A multi-flange hoop 400 is shown in FIG. 21 with non-flange 402 and flange 404 circumferential portions. The non-flange or flangeless portions may have varying degrees of flange removal to where the flange is reduced to being flush with the drumhead or membrane 18 or the flange is reduced to being recessed or spaced toward the opposing drum wall edge from the bearing edge. A non-flange or flangeless hoop 450 (FIG. 22) more clearly shows opposing bottom 452 and top 454 surfaces with the top surface clearly recessed or spaced from the drumhead in the embodiment shown. In either embodiment, the flangeless feature may be varied and a matter of degree or magnitude. Further, lug screws 420 are shown in each of FIGS. 21 & 22 to pull the respective hoop toward the opposing shell end or wall edge, which applies tension and stretches the membrane across the drum shell 12.

The lug screws 420 pass through the drum head hoop and thread into screw lugs 460. The screw lugs are generally a block of metal that are screw fastened to the shell 12. The actual screw thread engagement of the lug screws 420 with the lugs 460 may include a self-aligning drum lug mechanism, which has been well known in the art since about the 1930's. A deficiency with the known tension lugs 460 is the amount of surface contact between the lug and the shell, which results in muted or dead shell zones in the areas of the lugs.

An improved point suspension tension lug 470 of the invention is shown in FIGS. 23-26. The point suspension lug has a platform plate 472 which does not rest upon the drum shell. Rather, the platform 472 is connected with the drum shell by at least two legs 474 and preferably three as shown. The legs may be screws that extend through the platform plate 472 and into the drum shell 12. The plate is, however, spaced from the shell with spacing sleeves 473 over the screw legs. The inventor has found that a thick nylon washer and the like work well for the spacing sleeves, although various other cylinder members may be substituted. Thus, the point suspension lug 470 has only a few small areas of point contact with the drum shell, rather than full contact of the prior known suspension lug 460 with the shell 12.

The point suspension lug 470 also has a corresponding threaded bushing 476 or the like that cooperatively receives a lug screw in screw thread engagement. The bushing 476 is shown as a simplistic or schematic sketch in the drawing and may be interpreted from the drawing as being rigidly connected with the platform plate 472. This is not to be taken as a limitation of the invention, however. Rather, a point suspension lug of the invention may also incorporate a self aligning mechanism, which is well known in the art.

One having ordinary skill in the art and those who practice the invention will understand that various modifications and improvements may be made without departing from the disclosed inventive concept. Various relational terms, including left, right, front, back, top, and bottom, for example, are used in the detailed description of the invention and in the claims only to convey relative positioning of various elements of the claimed invention and are not otherwise used to limit the scope of the invention.

I claim:

1. A drum having a replaceable bearing edge comprising:

a tubular drum shell having first and second ends and an integral, one piece annular shell wall extending between the ends, the shell wall having inside and outside wall surfaces, the shell wall being sufficiently thick and rigid to support a membrane tightening ring by fastener anchors attached to the shell wall;

a first replaceable annular bearing member removably mounted on the first end of the shell, the bearing member having a membrane surface at an outer end that provides a membrane-support surface, the bearing member further having an annular shell surface at an inner end, the shell surface abutting and releasably fitting on the first end of the shell so as to be maintained in axial alignment therewith;

a membrane that fits over the membrane surface, the membrane having an enlarged outer edge;

a membrane tightening mechanism comprising an annular hoop that fits over the end of the shell and bearing member and engages the outer edge of the membrane, the hoop tightening the membrane on the bearing edge by means of adjustable fasteners that extend between the loop and anchors that are mounted on the shell.

2. The drum of claim 1 further including a second annular bearing member with an annular membrane surface and an opposing annular shell surface, the second bearing member overlaying the second wall edge with the bearing surface abutting the second wall edge.

3. The drum of claim 1 wherein the shell wall further includes an aperture extending through the wall, through each of the opposing inside and outside wall surfaces, whereby air may pass through the wall.

4. The drum of claim 3, further including an air valve connected with the aperture, the air valve being adapted to regulate passage of air through the aperature between open and closed posistons.

5. The drum of claim 4, wherein the air valve has a body that extends through the aperture and defines an air passage there through and the air valve has a cover that engages the body and is adapted to move between an open position in which the air passage is open and a closed position in which the air passage is closed.

6. The drum of claim 5, wherein the air valve is adapted to support a microphone.

7. The drum of claim 1 wherein at least a portion of the inside wall surface includes an acoustic pattern whereby sound generated by the drum is influenced.

8. The drum of claim 1, wherein the tubular shell further includes an aperture extending through the opposing inside and outside wall surfaces, whereby air may pass through the shell.

9. The drum of claim 8, further including an air valve connected with the aperture, the air valve being adapted to regulate passage of air through the aperture.

10. The drum of claim 9, wherein the air valve has a body that extends through the aperture and defines an air passage there through and the air valve has a cover that engages the body and is adapted to move between an open position in which the air passage is open and a closed position in which the air passage is closed.

11. The drum of claim 10, wherein the air valve is adapted to support an audio reception device.

12. The drum of claim 1 wherein at least a portion of the inside wall surface includes an acoustic pattern whereby sound generated by the drum is influenced.

13. A drum as in claim 1 wherein the bearing member abuts the end of the shell but does not overlap the outside wall surface of the shell, the bearing member having a flange positioned at an inner side of the bearing member, the flange overlapping and engaging the inside surface of the shell, the flange being in tight slip fit engagement with the bearing member on the end of the shell in axial alignment therewith without presenting an obstruction to the membrane at the outside surface of the shell.

14. A drum as in claim 1 wherein the annular hoop includes an upwardly extending peripheral flange that extends above the plane of the membrane at least at one spaced elevated location on the hoop.

15. A drum as in claim 14 wherein the flange is raised above the plane of the membrane at a plurality of spaced intervals around the periphery of the hoop, the periphery of the hoop being recessed below the level of the membrane at positions between the position where the flange is raised above the level of the membrane, the flange permitting a drummer to strike the flange or the edge of the membrane at alternating spaced locations around the periphery of the drum.

16. A drum as in claim 1 wherein the hoop has a peripheral edge that is positioned below the plane of the membrane around the entire periphery of the drum.

17. A drum as in claim 1 wherein the drum includes a plurality of interchangeable bearing members having shell surfaces that include one or more members selected from the group consisting of chamfered surfaces providing sharp or rounded membrane engaging ridges at positions between inner and outer sides of the bearing edges.

18. A drum as in claim 17 wherein the drum includes a plurality of bearing edges having different roundness and diametric positions for replacement to achieve different tonal responses.

19. A drum as in claim 17 wherein the drum includes a plurality of bearing edges for replacement when one bearing edge becomes damaged.

20. A drum as in claim 1 wherein the adjustable fasteners comprise threaded tension members that interconnect the hoop with the anchors comprising internally threaded lugs mounted on the outside surface of the shell, the lugs being attached to the shell by threaded fasteners, the lugs being spaced from the outside surface of the shell by spacers that position the lugs off of the surface of the shell.

21. A drum as in claim 20 wherein the spacers are annular members that are positioned over the threaded fasteners between the lugs and the shell.

22. A method of providing a drum with modifiable drum tonal characteristics comprising providing a drum with an annular shell and providing one or more replaceable bearing edges that are releasably mountable on ends of the shell, the bearing edges having shell surface that engage a membrane of the drum, the shell surface having different shapes and contours that give different tonal characteristics to the drum.

* * * * *